US006367226B1

(12) United States Patent
Shauf, Sr. et al.

(10) Patent No.: US 6,367,226 B1
(45) Date of Patent: Apr. 9, 2002

(54) UTILITY POLE CROSSARM, CROSSARM ASSEMBLY, AND METHOD OF MANUFACTURE

(75) Inventors: Mitchell Earl Shauf, Sr.; Ronald L. Ross, both of Gainesville, TX (US)

(73) Assignee: Petroflex N.A., Inc., Gainesville, TX (US)

( * ) Notice: Subject to any disclaimer, the term of this patent is extended or adjusted under 35 U.S.C. 154(b) by 0 days.

(21) Appl. No.: 09/306,506

(22) Filed: May 6, 1999

(51) Int. Cl.[7] ..... E04C 3/30

(52) U.S. Cl. ..... 52/736.2; 52/697; 52/40; 52/736.3; 52/309.15

(58) Field of Search ..... 52/736.2, 40, 697, 52/309.15, 720.1, 731.1, 736.3; 428/543, 35.7, 147

(56) References Cited

U.S. PATENT DOCUMENTS 3,468,571 A * 9/1969 Farmer ..... 52/726.2
4,262,047 A * 4/1981 Barnett et al. ..... 428/73
5,573,348 A * 11/1996 Morgan ..... 405/52
5,605,017 A * 2/1997 Fingerson et al. ..... 52/40
5,725,940 A * 3/1998 Sakai et al. ..... 428/318.6
5,775,035 A * 7/1998 Papin ..... 52/100
6,164,034 A * 12/2000 Roetheli et al. ..... 52/560

* cited by examiner

*Primary Examiner*—Carl D. Friedman
*Assistant Examiner*—Jennifer I. Thissell
(74) *Attorney, Agent, or Firm*—Shughart Thomson & Kilroy P.C.; Mark E. Brown

(57) ABSTRACT

A utility pole crossarm assembly includes a crossarm comprising a plastic base material with fiber reinforced plastic fill material and a foaming agent. The crossarm is adapted for bolting on a utility pole and for being supported thereon by a pair of diagonal cross braces.

1 Claim, 3 Drawing Sheets

UTILITY POLE CROSSARM, CROSSARM ASSEMBLY, AND METHOD OF MANUFACTURE

BACKGROUND OF THE INVENTION

1. Field of the Invention

The present invention relates generally to utility transmission and distribution, and in particular to a plastic crossarm for utility poles.

2. Description of the Prior Art

Utility poles are in widespread use for suspending utility lines, including electrical power, telephone, etc. at safe distances above a ground surface. Utility pole components have traditionally been manufactured predominantly of wood, which has the advantages of being relatively ubiquitous, in expensive, nonconductive, and generally at least adequate as a structural material with desired strength characteristics.

Disadvantages of wood include its susceptibility to damage from insects, birds, termites, etc. Wood is also subject to attack by biological organisms, particularly in humid environments. Still further, wood tends to deteriorate when exposed to the elements, such as ultraviolet radiation, precipitation, humidity, temperature cycles, etc. These and other factors have the cumulative effect of reducing the useful lives of structural members which are exposed to the elements and accessible to tests.

Plastic is often used as a replacement material for wood. For example, recycled plastic/composite railroad ties have been substituted for wood railroad ties. Still further, to maximize the useful life of exposed wooden structural members, standard practice is to coat them with a preservative, such as creosote. However, environmental laws and regulations significantly limit the permitted uses of wood preservatives, particularly those that contain toxins.

Although plastic materials tend to repel or resist water and are nonconductive, their disadvantages include susceptibility to ultraviolet radiation, higher densities as compared to wood and cost. The present invention addresses some or all of the disadvantages and limitations associated with wooden and plastic utility pole crossarm and crossarm assemblies. Heretofore there has not been available a utility pole crossarm, crossarm assembly, or manufacturing method with the advantages and features of the present invention.

SUMMARY OF THE INVENTION

In the practice of the present invention, a utility pole crossarm is manufactured from a plastic material and has a relatively dense outer surface and a less dense core. A crossarm assembly includes a plastic crossarm and a pair of diagonal braces for supporting the crossarm on the utility pole. A method of manufacturing the crossarm and the crossarm assembly includes extruding a continuous band comprising a polypropylene base material, a fiber reinforced plastic fill material, and a blowing or foaming agent. The materials are combined and extruded to form the continuous band, which is shaped and cooled in several stages and cut to predetermined lengths to form the crossarms.

Objects and Advantages of the Invention The principal objects and advantages of the present invention include: dividing a plastic crossarm for utility poles; providing such a crossarm which is resistant to the elements; providing such a crossarm which is resistant to pest damage; providing such a crossarm which meets or exceeds the strength specifications for wooden crossarms; providing such a crossarm which weighs approximately the same amount as a comparable wood crossarm; can be cut, drilled, etc. with tools used for working on wooden crossarm; providing such a crossarm which utilizes recycled plastic; providing such a crossarm assembly with a plastic crossarm and plastic braces; and providing such a crossarm which is economical to manufacture, efficient in operation, capable of a long operating life and particularly well adapted for the proposed usage thereof; providing a crossarm assembly with a plastic crossarm and plastic diagonal braces; and providing a method of manufacturing a plastic crossarm assembly.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
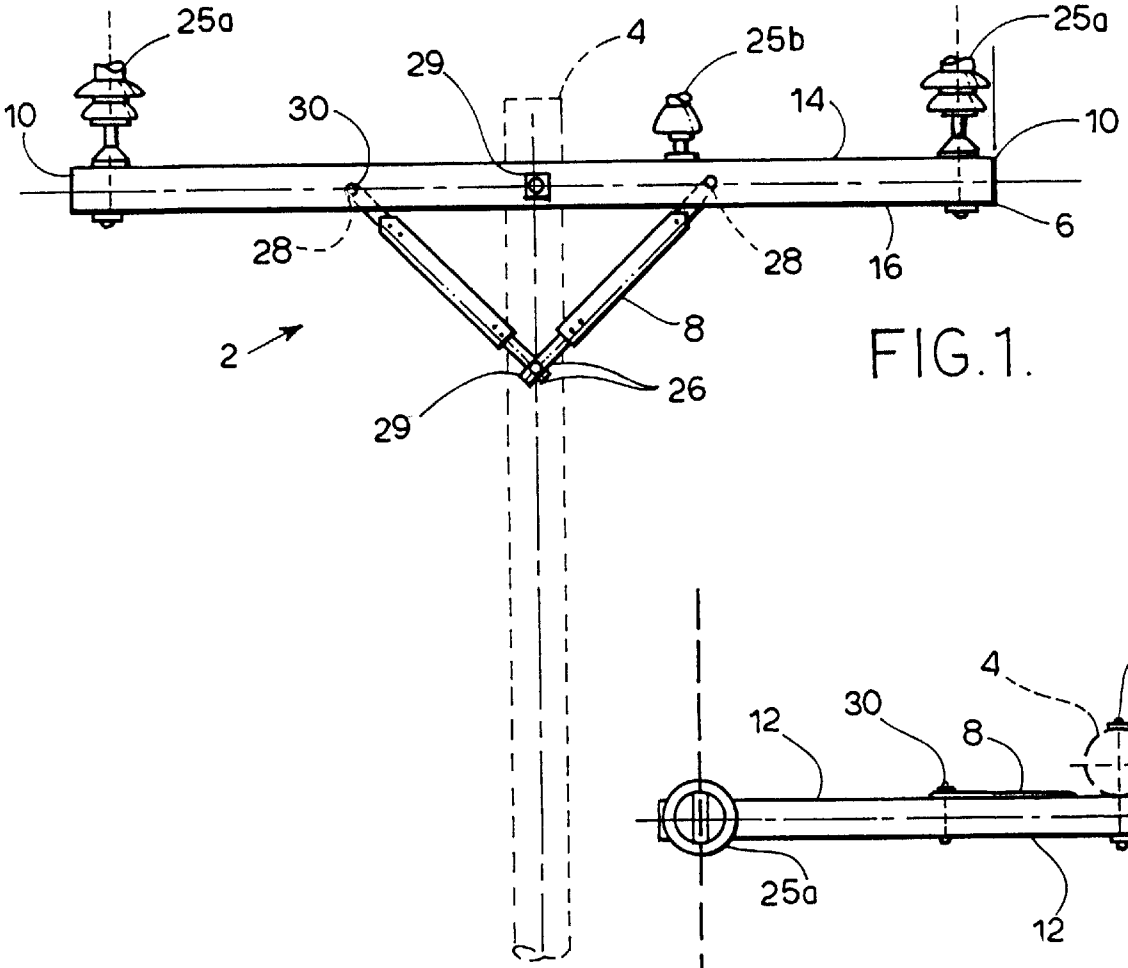
FIG. 1 is a fragmentary, vertical, elevational view of a utility pole assembly including a crossarm and crossarm assembly embodying the present invention; the pole is shown in broken lines.
Figure 2:
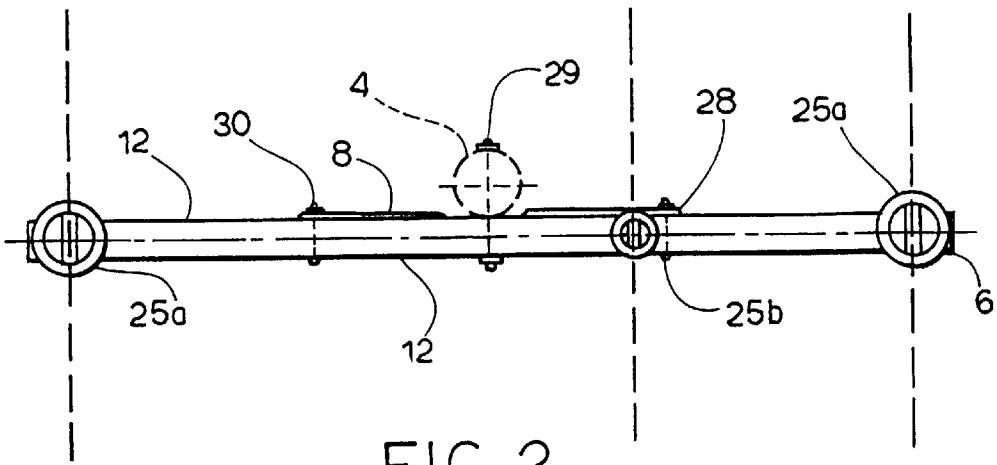
FIG. 2 is a top plan view thereof.
Figure 3:
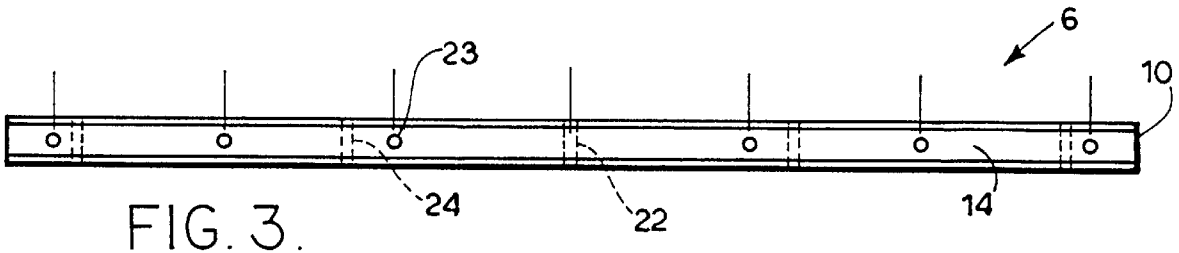
FIG. 3 is a top plan view of a crossarm embodying the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, reference numeral 2 generally designates a crossarm assembly embodying the present invention and mounted on a utility pole 4. "Crossarm" as used herein includes a wide variety of structural members mounted on utility poles, including buckarms, twinarms, dead ends, etc. The crossarm assembly 2 generally includes a crossarm 6 and a pair of diagonal braces 8.

II. Crossarm 6

The crossarm 6 includes opposite ends 10, opposite side faces 12, and top and bottom faces 14, 16. The crossarm 6 includes an outer surface 18 and an inner core 20. The core 20 includes entrained voids which are formed by a foaming or blowing agent introduced into the plastic and fiber reinforced plastic base and fill materials in the manufacturing process, as described below. The core 20 is thus less dense than the outer surface 18. A medial, horizontal bolt or pin hole 22 extends between and is open at the side faces 12.

Multiple lateral, horizontal holes 24 also extend between and are open at the side faces 12. Each lateral hole 24 is located between a respective crossarm end 10 and the medial bolt hole 22. Vertical holes 29 can be provided at suitable locations in the crossarm 6, for example, at spaced locations for mounting electrical insulators 25*a,b,* hangers, etc. The crossarm 6 includes radiussed upper and lower edges 21*a,b.*

II. Braces 8

Each brace 8 includes inner and outer ends 26, 28. The brace inner ends 26 are mounted on the utility pole 4 by a brace/pole mounting bolt 29. The brace outer ends 28 are mounted on the crossarm 6 by brace/crossarm mounting bolts 30 extending through brace outer ends 28 and respective lateral bolt holes 24.

IV. Crossarm Manufacturing Method.

Figure 4:
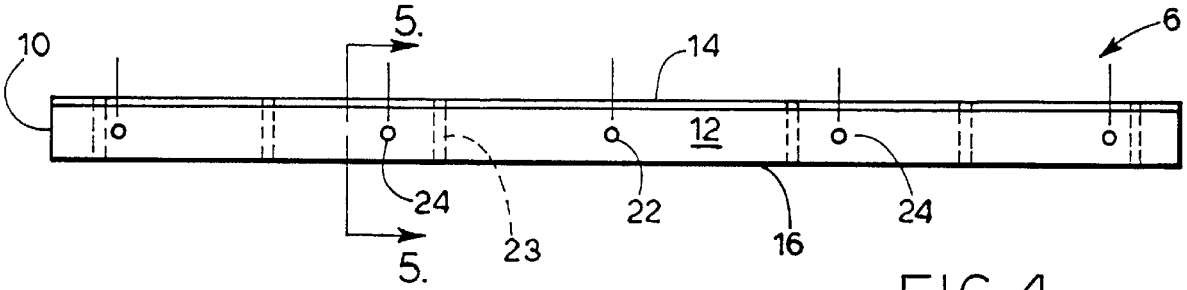
FIG. 4 is an elevational view thereof.
Figure 5:
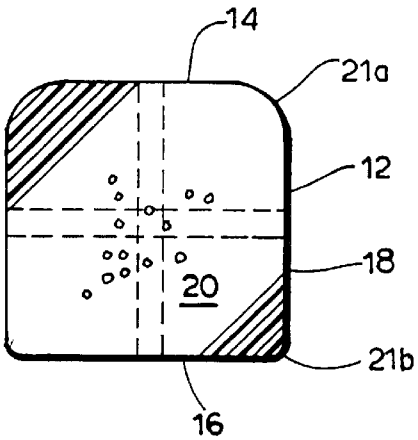
FIG. 5 is a vertical, cross-sectional view thereof, taken generally along line 5—5 in FIG. 4.
Figure 6:
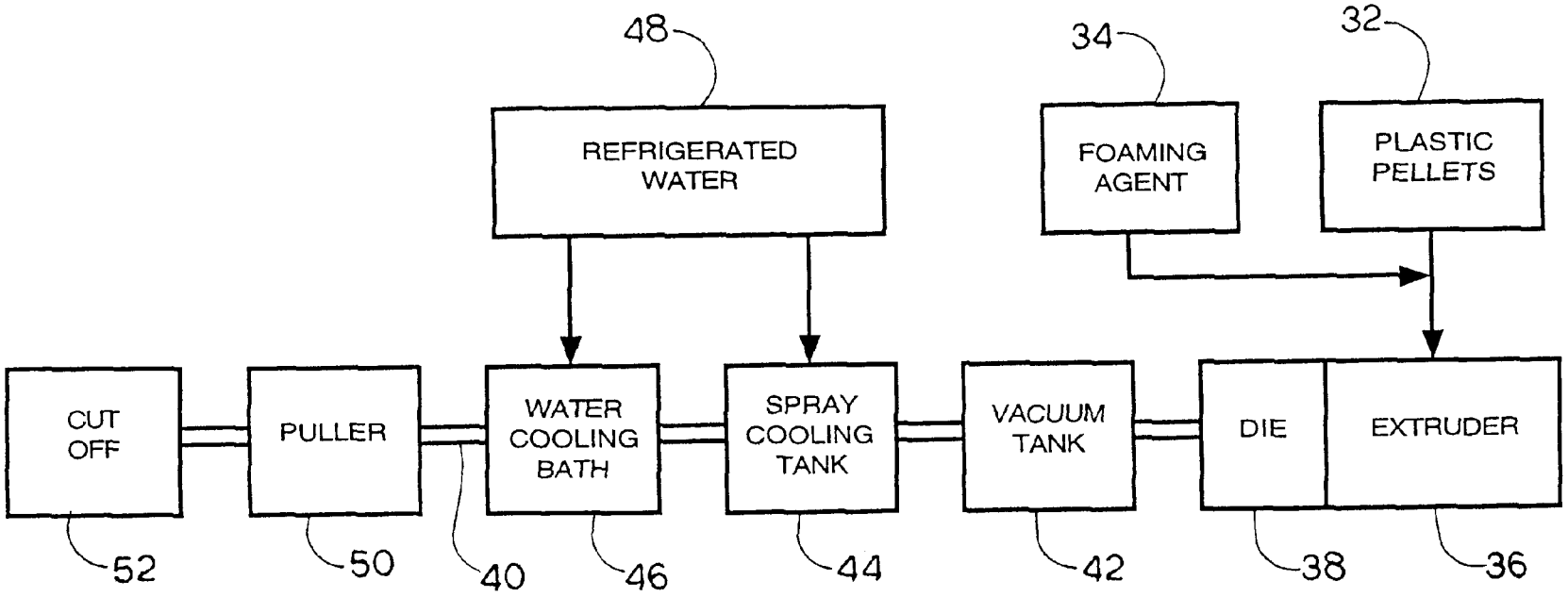
FIG. 6 is a block diagram of a flowchart showing a method of manufacturing the crossarm and the crossarm assembly.

FIG. 4 is a flow chart showing a method of manufacturing the crossarm 6 and the crossarm assembly 2. The method includes the steps of providing a source 32 of plastic pellets. Without limitation of the generality of useful plastic base materials for the crossarm 2, polypropylene base material (e.g., NT-418.T001-8000) with 10% to 50% fiber reinforced plastic fill material has been found to be particularly suitable for use in the manufacture of the crossarm 6. A foaming agent source 34 is also provided and introduces a suitable foaming or blowing agent, such as Rowa Tracel P02201-P, into the pellet stream from the pellet source 32. The combination of plastic pellets and foaming agent is introduced into an extruder 36 which can apply mechanical energy and/or heat to the raw material mixture which is forced through a forming dye 38 mounted on the extruder. From the extruder dye 38 a continuous band 40 of crossarm stock emerges and enters a vacuum tank which includes a sizer. The stock band 40 is formed to a predetermined size with relatively constant thickness and height dimensions in the vacuum tank 42.

Upon exiting the vacuum tank 42, the band 40 is subjected to an annealing step whereafter it enters a spray cooling tank 44. Upon exiting the spray cooling tank 44, the band 40 is again subjected to an annealing step and enters a second cooling process in a water cooling bath 46 wherein the band 40 is submerged. In the spray cooling tank 44 the band 40 generally floats on the surface of the water and is subjected to continuous spray. In the second water cooling bath 46 the band 40 is submerged. The cooling water is provided by a refrigerated water source 48 whereby its temperature is lowered to approximately 55°. A puller 50 is positioned downstream of the water cooling bath 46 and pulls the band 40 through the production process. Upon exiting the puller 50, the band 40 is cut to predetermined lengths by a cutoff saw 52.

The following test results were obtained in load/deflection testing in accordance with Rural Utility Services (RUS) test requirements. The test procedure involved placing the crossarm in a rigid test frame and securing it at a point fourteen inches from the outermost hole. Upward pulling forces were applied at the outermost hole and deflection measurements were recorded in increments up to a load of 1000 pounds. Loading was then continued until failure occurred. The procedure was formed on both ends of the crossarm. The results of these tests are summarized as follows:

| Applied Load (LBS) | Test #1/Deflection (IN) | Test #2/Deflection (IN) |
|---|---|---|
| 250 | 7/16 | 5/16 |
| 500 | 13/16 | 7/8 |
| 750 | 1 1/4 | 1 3/8 |
| 1000 | 1 3/4 | 1 15/16 |
| Ultimate load (lbs) | 1925 | 1675 |

It is to be understood that while certain forms of the present invention have been illustrated and described herein, it is not to be limited to the specific forms or arrangement of parts described and shown.

What is claimed and desired to be secured by letters patent is as follows:

1. A structural member, which comprises:

(a) an outer surface;

(b) an inner core;

(c) a polypropylene base material;

(d) a fiber reinforced plastic fill material mixed with the base material;

(e) a foaming agent mixed with the base and fill materials;

(f) said inner core having entrained airpockets distributed throughout same; and (g) said structural member having a greater density adjacent to its outer surface than in said inner core thereof.

* * * * *